United States Patent [19]

Gidge et al.

[11] Patent Number: 4,578,141

[45] Date of Patent: Mar. 25, 1986

[54] WEFT FORMING APPARATUS

[75] Inventors: Lester Gidge, Nashua; Ronald P. Murro, Amherst, both of N.H.

[73] Assignee: Bay Mills Limited, Toronto, Canada

[21] Appl. No.: 570,385

[22] Filed: Jan. 13, 1984

[51] Int. Cl.[4] ..... B32B 5/12; D04H 3/05

[52] U.S. Cl. ..... 156/439; 28/101; 28/102; 156/177; 156/181

[58] Field of Search ..... 156/177, 439, 440, 441, 156/181; 28/101, 102; 66/84 A

[56] References Cited

U.S. PATENT DOCUMENTS

| | | | |
|---|---|---|---|
| 2,954,816 | 10/1960 | Havemann | 156/177 |
| 3,345,231 | 10/1967 | Gidge et al. | 28/102 |
| 3,345,232 | 10/1967 | Gidge et al. | 66/84 A |
| 3,490,976 | 1/1970 | Gidge | 156/440 |
| 3,519,509 | 7/1970 | Gidge et al. | 156/440 |
| 3,605,220 | 9/1971 | Atwood et al. | 156/440 |
| 3,675,285 | 7/1972 | Atwood et al. | 156/440 |

*Primary Examiner*—Michael Ball

*Attorney, Agent, or Firm*—Pearson & Pearson

[57] ABSTRACT

An apparatus and method for continuously forming a succession of individual, full width, weft yarns by means of a turret rotating in a horizontal plane on a vertical axis and carrying a plurality of weft yarn packages. The weft yarns are drawn off the packages to full width by two pairs of belts, carrying spaced pairs of pins, advancing along a generally horizontal path parallel to the plane of the turret and parallel to the plane in which the weft strands travel, then cut off at full width and spread out by clamp belts and cables to extend laterally and horizontally across the machine. A plurality of warp yarns, each carrying adhesive are laid on the weft yarns and the resulting skrim unitized on a heated drum with the assistance of heated air from a blower.

6 Claims, 7 Drawing Figures

WEFT FORMING APPARATUS

BACKGROUND OF THE INVENTION

It has heretofore been proposed to make a non-woven, criss cross network by overlaying one set of yarns transversely on another set of yarns and to adhere the intersections so as to form a unitary, strippable, self-supporting network.

Exemplary of patents relating to apparatus and methods for making such a product are the following, all of which, in general, teach the use of a laterally reciprocating weft carrier which loops the yarns around the upstanding pins of a pair of close spaced, parallel, chains, the chains then spreading apart to the full width of the network while pulling the yarns from the yarn packages. The warp yarns are then laid over the weft yarns and the intersections adhered so that the product becomes unitary.

| | | |
|---|---|---|
| U.S. Pat. No. 3,345,231 | Gidge, et al | October 3, 1967 |
| U.S. Pat. No. 3,345,232 | Gidge, et al | October 3, 1967 |
| U.S. Pat. No. 3,490,976 | Gidge | January 20, 1970 |
| U.S. Pat. No. 3,519,509 | Gidge | July 7, 1970 |
| U.S. Pat. No. 3,605,220 | Atwood | Sept. 20, 1971 |
| U.S. Pat. No. 3,675,285 | Atwood | July 11, 1972 |
| U.S. Pat. No. 3,829,339 | Pinette | Aug. 13, 1974 |

Rotating warp carriers for making such non-woven netting have been proposed as in U.S. Pat. No. 3,817,807 to Braun of June 18, 1974 wherein warp yarns are wrapped helically around a a stationary mandrel for right angular application of weft yarns by a circular carrier.

A rotating member for applying weft yarns is also disclosed in U.S. Pat. No. 4,108,708 to Gregory of Aug. 22, 1978.

Rotating turret members are disclosed in U.S. Pat. Nos. to Havemann of Oct. 4, 1960, U.S. Pat. Nos. 2,954,816 and 2,954,817 wherein drawing off is by means for forming a continuous length of strand-like material into continuous, genrally helical convolutions.

SUMMARY OF THE INVENTION

This invention does not make use of a reciprocating weft carrier moving transversely back and forth between closely spaced pin carrying elements and does not make use of pin carrying elements as loop receiving elements as taught in the prior art. Instead the weft strands are drawn off packages mounted on a turret rotating in a horizontal plane on a vertical axis, then each opposite end of each individual and successive weft strand is clamped in one of a pair of weft carrying members each consisting of an endless grooved belt with an endless cable seated in the groove. The two endless belt and cable weft carriers of the pair then spread out to full width of the desired network while advancing along a path. A plurality of warp yarns are laid on longitudinally of the laterally extending, cut off, warp yarns, after passing through an adhesive immersion bath to apply adhesive to the intersections. The resulting netting then is carried around the upper surface of a heated drum to set the adhesive, whereupon it is released by the clamp cable and belts, for stripping as a unitary, criss cross, unwoven, self-supporting network.

DESCRIPTION OF A PREFERRED EMBODIMENT

Figure 1:
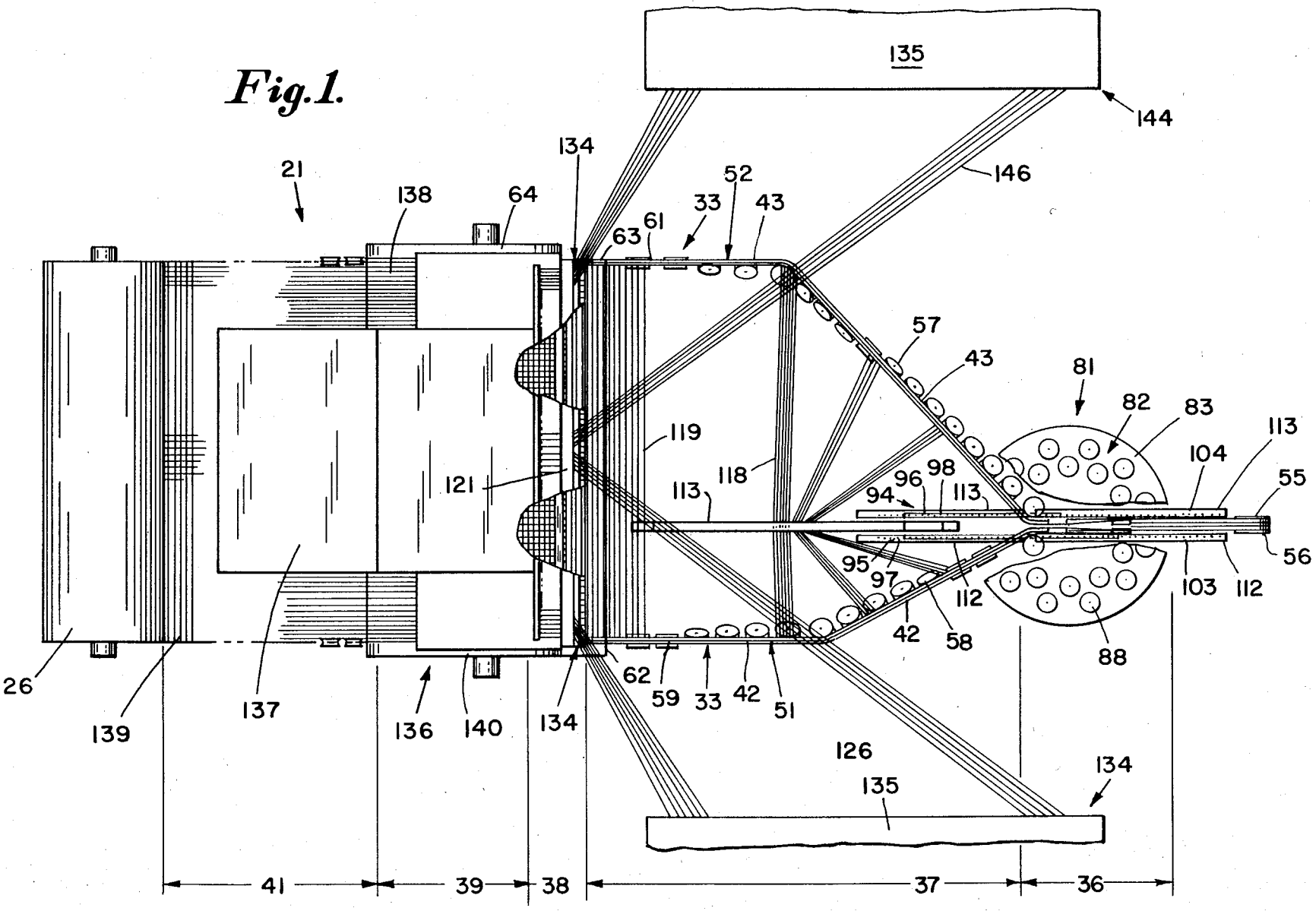
FIG. 1, is a diagrammatic top plan view of the scrim machien of the invention.

As shown in the drawings, the machine 21, of the invention includes a base 22, set on floor 23, and a main frame 24, subframes 25 for a power operated wind up roll 26, rotatable in bearings such as 27. The wind up roll floats in the smaller diameter rolls 28 and 29 which are journalled in bearings such as 31 and 32.

Endless weft carrier means 33 is provided including a pair of laterally spaced stretches 34 and 35 mounted to advance longitudinally along a generally horizontal path 40 through machine 21 from the weft strand supply zone 36, through a weft strand spreading zone 37, a warp yarn application and adhesive zone 38 and an adhesive drying zone 39 to a netting stripping zone 41.

Figure 6:
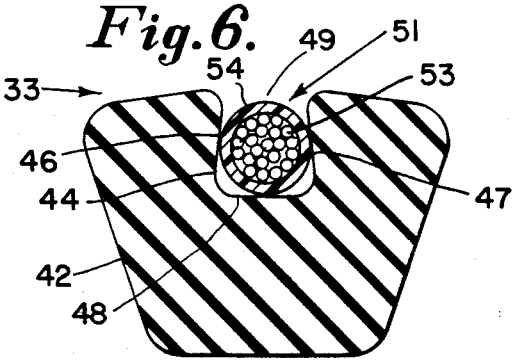
FIG. 6 is an enlarged, frengmentary, sectional view showing the grooved belt and clamping means without a yarn end therein.
Figure 7:
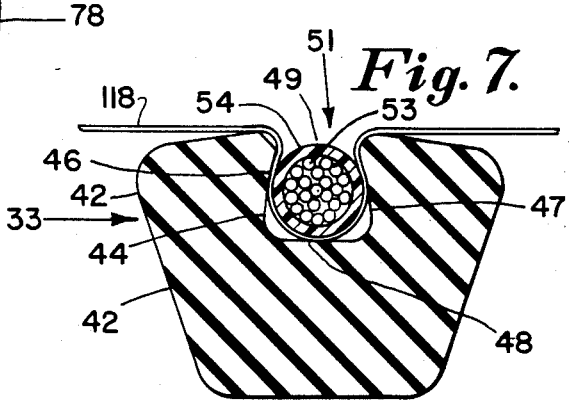
FIG. 7, is a view similar to FIG. 6 showing a yarn end clamped by a cable in the cable groove of a belt.

The endless weft carrier means 33 is formed by a pair of endless belts 42 and 43, of rubber or the like, each having a cable groove such as 44 or 45 therein, and each groove having opposite side walls 46 and 47 which incline slightly toward each other from the groove bottom 48 to the groove opening 49, as best shown in FIG. 6, and FIG. 7.

A pair of endless cables 51 and 52, each cable preferably formed of flexible strong wire 53 with a smooth surfaced flexible coating of plastic 54, cooperate with the pair of endless grooved belts 43 and 43 to form a pair of endless clamps for holding the opposite ends of weft strands between cable and groove when each cable is seated in the groove of the belt.

Figure 2:
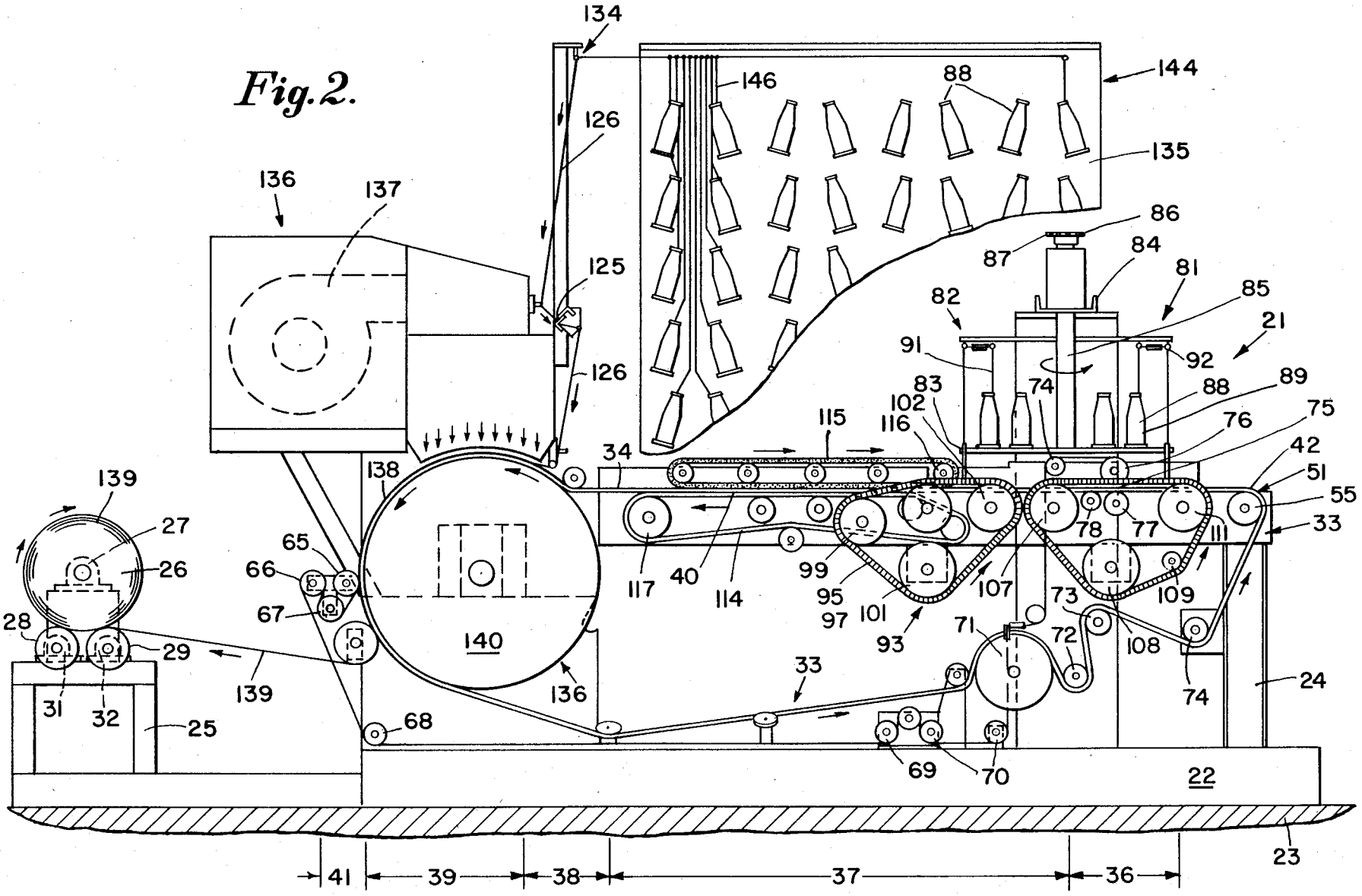
FIG. 2, is a diagrammatic side elevational view thereof.

Referring to FIGS. 1 and 2, each endless grooved belt 42 and 43 is trained around a sheave such as 55 or 56 to pass through the weft supply zone, 36 in closely spaced parallelism, then the two belts diverge away from each other on sheaves such as 57 or 58 until spaced apart the full width of the netting, then the two upper stretches advance in parallelism again at 59 and 61 to pass under sheaves such as 62 and 63 and around the heating drum 64.

The cables 51 and 52 are stripped from the grooves in the belts on the far side of drum 64 by sheaves 65, 66 and 67 and follow a return stretch on sheaves 68, 69, 70, 71, 72, 73 and 74, at which point the nip 75 of insertion roll 76, and nip roll 77 inserts the cable back into the groove of the belt. It is thus ready to clamp the end of a weft yarn cut off by the disc cutter 78, located just in front of the cable insertion nip 75.

The weft strand supply means 81 of the invention is located in the weft supply zone 36 of machine 21 and includes rotatable turret means 82 having a circular support 83, mounted to rotate in a horizontal plane on a vertical axis by depending from an inverted U shaped frame 84 which straddles the machine and is only partially shown. The support 83 depends from the shaft 85, and is rotated by the sprocket 86 and chain 87, and a drive motor not shown.

A plurality of packages, such as spools 88, of weft yarn 89 are spaced around support 83, the yarn 91 from each package leading upwardly to tension mechanism 92 and thence downwardly for individual and successive draw off as transverse, cut-off, weft yarns drawn off by the endless draw off means 93 of the invention. The support 83 may have about twenty-four spools, bobbins, or packages spaced therearound although a lesser number is shown for clarity.

The endless draw-off means 93 comprises a pair 94 of forward weft yarn pin belts 95 and 96 each with a plurlity of upstanding pins such as 97 and 98 spaced therearound and each trained around sheaves such as 99, 101, and 102. Mechanism 93 also includes a pair of trailing weft yarn pin belts 103 and 104, each with a plurality of upstanding pins such as 105 and 106 spaced therearound and each trained around sheaves such as 107, 108, 109 and 111. The trailing pin belts are adjustable to move longitudinally of machine 21 by suitable mechanism not shown. Both pairs of pin belts are driven in synchronism with the drive of the turret, by drive trains from a motor not shown, to form the pair of parallel, spaced apart stretches 112 and 113 advancing longitudinally along the horizontal path 40 through the machine.

The disc cutter 78 is driven by a separate motor not shown.

Upper and lower hold down belts 114 and 115 are each trained around sets of rolls 116 and 117 respectively (FIG. 2) to exert a slippable friction clamping force on the central portion of each individual and successive cut-off weft strand, such as 118 and 119 (FIG. 1) as the strands are being spread out to full width of the machine by the clamp belts and cables.

Figure 3:
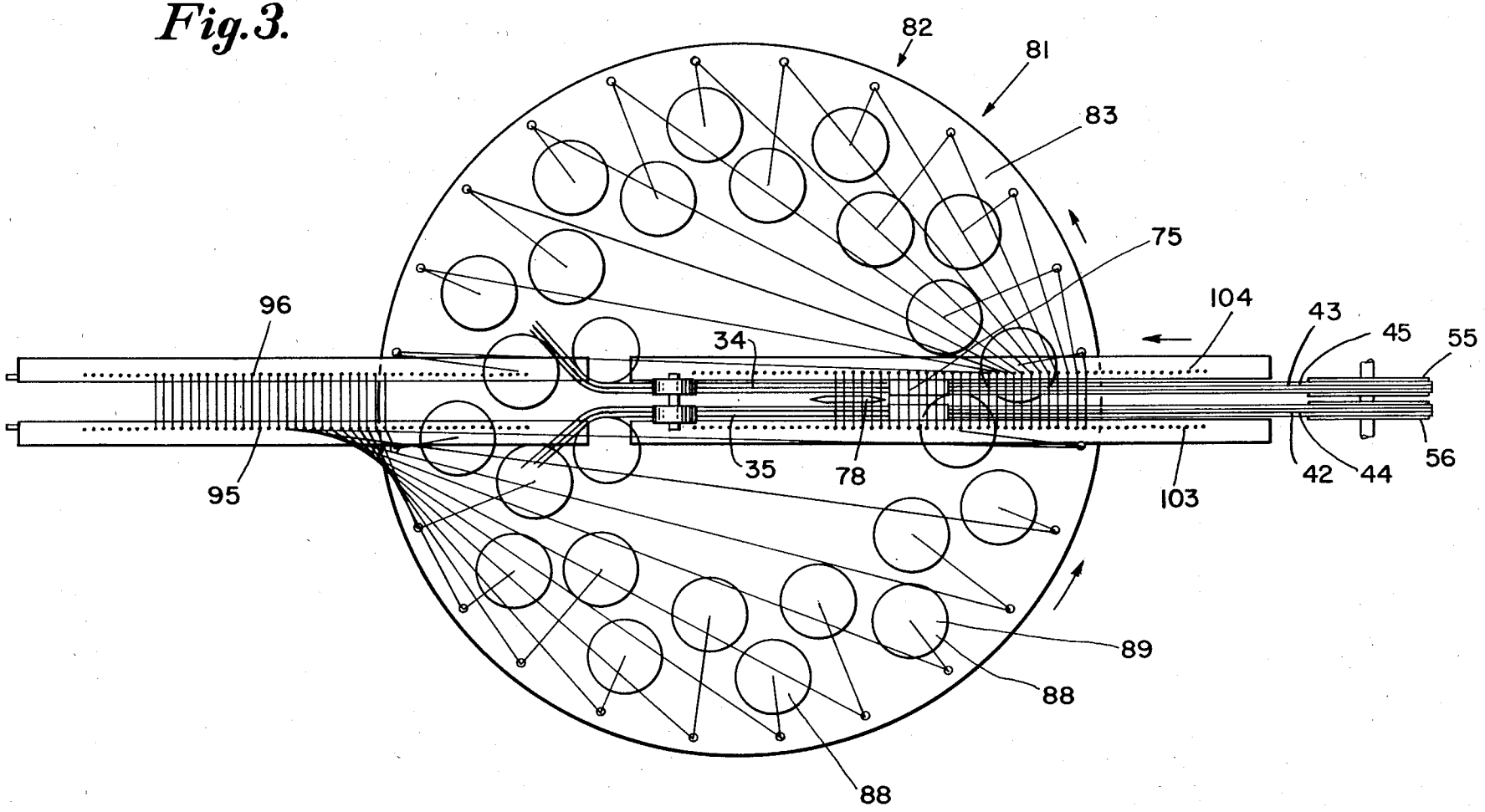
FIG. 3, is an enlarged diagrammatic top plan view of the rotary filling supply member of the invention.
Figure 4:
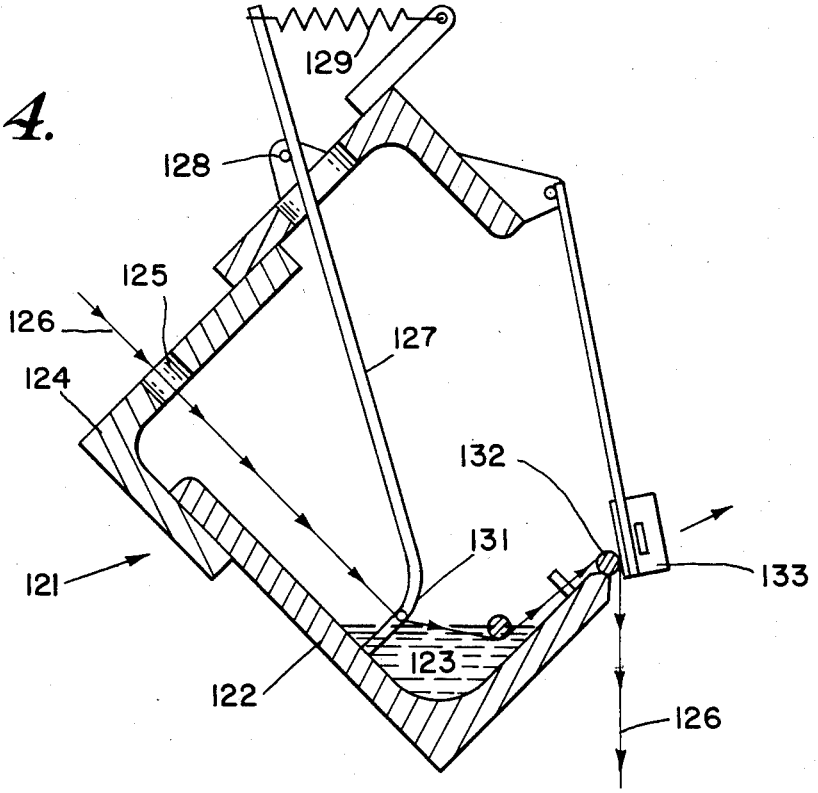
FIG. 4 is an enlarged diagrammatic side elevation of the adhesive supply member of the invention.
Figure 5:
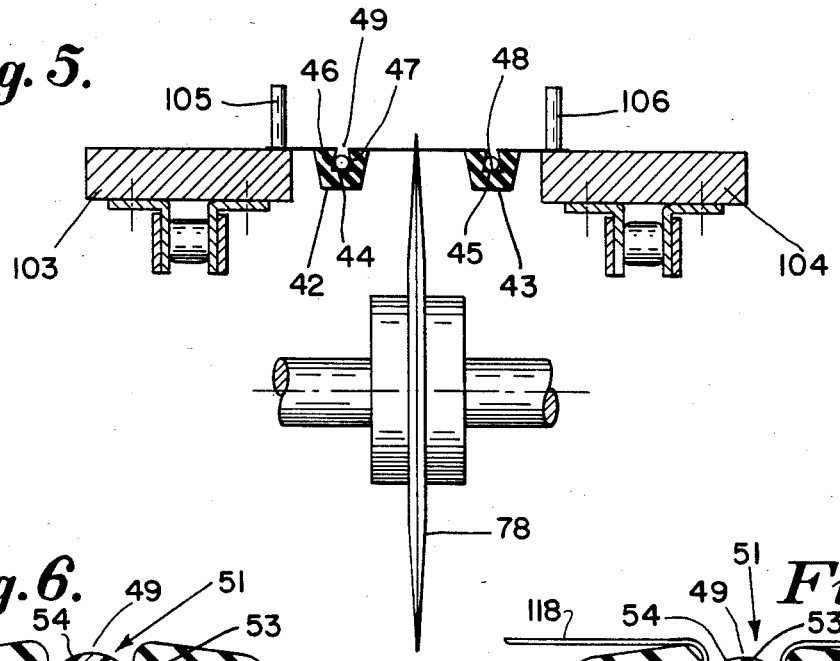
FIG. 5 is a fragmentary diagrammatic end elevation, in section, of the belt and groove strand carriers and disc cutter of the invention.

In FIG. 3 the cooperation of the draw-off means, carrier belts, disc cutter clamp belts and cables, and rotating turret is shown diagrammatically. It will be seen that as the turret support 83 is rotated counterclockwise, and as the draw-off pins advance thereunder along generally horizontal path 40, each pair of oppositely disposed pins advance about ten or twelve inches along the path 40 while the support, being about forty inches in diameter, completes a revolution so that each package has advanced forty inches and retreated forty inches for a total of eighty inches.

The cable insertion nip 75 is in advance of the disc cutter 78, so that both sides of a weft yarn extends between a pair of slowly advancing pins are are clamped in the clamp belts before the yarn is cut. Thus, one end of the yarn is free to advance with its previously cut other end to form a laterally extending weft yarn, while the remaining end is still connected to its package on the turret support and is also clamped by the adjacent belt-cable clamp. The turret, however, in rotating counterclockwise in a circle of forty inch diameter, pays off more strand from its package, with the end held in the belt clamp until it reaches 180° of its circular path where it passes the strand, being continuously drawn off, through a forward set of pins, and then pay off continues from the package as the support rotates the remainder of its rearward 180° path. After the support leads this strand back through the pins to the other side, cut-off occurs and the cycle is repeated for the next weft strand from that package and each strand of each package follows the cycle individually and successively. The pins of the forward pair 94, drop below the level of the path 40 to release the weft yarns to the frictional grip of the carrier belts as shown.

There is preferably about a twenty-four pin differential between the pins at one end of each weft yarn and the pins at the other end, and it has been found preferable to have one angled stretch of the clamp belts longer than the other as shown to compensate for the same.

An adhesive applicator 121 extends laterally of the path 40 and includes a container 122 for a water based adhesive 123 there being a back plate 124 having a plurality of spaced holes 125 each for an individual warp yarn such as 126. A tension arm 127 is pivoted at 128 and spring biased at 129 to exert desired tension at its contact finger 131 within the bath of adhesive 123. A rod 132 of circular cross section forms a curved lip, or guide, for each warp yarn exiting from the bath and wipes off excess adhesive in cooperation with a pivoted wiper blade 133.

Warp yarn supply means 134 includes a creel frame 135, holding a plurality of warp yarn packages, or creels, such as 188, each for one of a plurality of warp yarns 126. The yarns 126 are guided through guides 134, thence through the apertures 125 and thence are laid on the individual and successive weft yarns advancing in the clamp belts under sheaves 56 and around the heated drum 140.

Heating means 136 includes the drum 140 which is heated by the powered blower 137 which directs hot air down on the netting 138, being carried around the drum by the belts. The drum is also heated internally in a well known manner so that the water in the adhesive is removed and the netting 138 is firmly adhered at the intersections of warp and weft yarns to form the desired strippable, unitary, self-supporting non-woven netting at 139.

It will be understood that the weft forming machine and method of the invention, including the steps of drawing off a succession of full width, individual, weft strands from a plurality of weft supply packages, clamping the opposite ends of each successive, individual, full width, weft strand in a pair of endless flexible carriers, cutting off the weft strands from their supply packages, and advancing them while extended full width between carriers along a path to a final treatment zone produces a useful product.

The sheet of individual and successive, full width, parallel weft strands, in the treatment zone can be combined with warp yarns, adhered, dried and stripped as a unitary network as described above. It can also be laminated to a single endless, flexible web, or between a pair of endless flexible webs as a sandwich to reinforce tape, roofing paper, or many other products. If no warp yarns, no adhesive, and no drying are required, the cables are stripped from the belts at the end of zone 37 to return to their start point and the supporting web, to be reinforced by the weft strands, is introduced just before the stripping of the cables.

We claim:

1. A weft forming section of a machine for forming a sheet of yarns, said section comprising:

endless weft strand carrier means including a pair of laterally spaced stretches, mounted to advance longitudinally along a generally horizontal path through said section;

weft supply means including a turret having a plurality of packages thereon and rotatable in a horizontal plane on a vertical axis and;

endless draw-off means including a pair of parallel, spaced apart endless belt stretches, advancing longitudinally in a plane parallel to the plane of said turret along said path and having a plurality of pairs of draw-off pins spaced therealong;

said weft supply mans and said draw-off means being oprably connected to individually and successively draw-off a full width length of weft strand from each package, cut it off and deliver it to said endless weft strand carrier means.

2. A machine for making non-woven netting of predetermined full width, said netting having warpwise extending strands adhered at intersections with weftwise extending strands, said machine comprising:

endless weft strand carrier means including a pair of laterally spaced endless grooved belt stretches, mounted to advance longitudinally along a generaly horizontal path through said machine from a weft strand supply zone, through a weft strand spreading zone, a warp yarn application and adhesion zone, and an adhesive drying zone to a stripping zone and endless cables seated in the grooves of said belts for clamping weft strands therebetween;

weft strand supply means, in said weft strand supply zone, including;

a turret rotatable in a horizontal plane on a vertical axis and having a plurality of packages of weft strands spaced therearound;

endless draw-off means, comprising a pair of parallel, spaced apart upper, endless belt stretches advancing longitudinally along said horizontal path and in a horizontal plane parallel to the plane of said turret and parallel to the plane in which the weft strand carrier means travel and having a plurality of paris of draw-off pins spaced therealong;

said turret and said draw-off means being operably connected to individually and successively draw-off a full width length of weft strand from each package, cut it off and deliver it to said endless weft strand carrier means for spreading to said full width in said weft strand spreading zone;

an adhesive applicator, extending laterally across said path, in said warp yarn application and adhesive zone;

warp yarn supply means, continuously supplying a plurality of longitudinally extending, laterally spaced, warp yarns to said adhesive applicator, and thence to superposed contact on said laterally extending, full width weft yarns in said warp yarn applicator and adhesive zone for forming a meshed network therewith;

heating means in said adhesive drying zone for drying said adhesive to unitize said network into strippable, netting, said network being advanced through said drying zone by said grooved belts and cables;

and stripping means in said stripping zone for stripping said strippable netting from said weft strand carrier means and said heating means.

3. A machine as specified in claim 2 wherein:

said endless weft carrier means includes a pair of hold down belts each having a lower stretch in contact with one of said grooved endless belts to retain said cables in said grooves.

4. A machine as specified in claim 2 wherein:

said endless draw-off means comprises two pairs of laterally spaced, longitudinally extending, parallel endless belts, a forward pair and a trailing pair each having pins extending outwardly therefrom, the pins on the parallel upper stretches being aligned laterally in successive pairs and each pair being adapted to pull a strand from a package on said rotatable turret as said stretches advance and said turret rotates.

5. A machine as specified in claim 2 wherein:

said heating means is a large diameter drum, having a cylindrical surface, supporting said unitized network while advancing it along said heating zone, means for heating said surface from inside said drum and means for blowing heated air on the exterior surface of said drum.

6. A machine for making an elongated web of netting, or scrim, having longitudinally extending warp strands adhered at the intersections to laterally extending weft yarns, said machine comprising:

a pair of endless carriers, each formed by an endless grooved belt and an endless cable clamp fitting in the groove of said belt, each carrier extending along a generally horizontal path through said machine from a weft strand supply zone where said carriers are closely spaced, through a spreading zone, where the carriers spread apart from each other to full weft width, through a warp yarn applicator and adhesive zone, then a heating zone and then a stripping zone and a pair of hold down belts mounted above said path in said spreading zone, each having a lower stretch in contact with the cable in the cable groove of one of said belts to exert a slippable friction clamping force on the weft strands clamped therein;

means in said weft strand supply zone for individually and successively supply cut lengths of weft strands to said carriers for spreading said strands in a horizontal plane to extend laterally to full width as they advance along said horizontal path toward said warp applicator and adhesive zone said means including a turret rotating in a horizontal plane on a vertical axis and carrying a plurality of packages of weft yarns;

pairs of pin carrying belts advancing along a generally horizontal plane parallel to the plane of rotation of said turret, for drawing off individual and successive weft strands of full width from said packages on said turret;

means in said warp applicator and adhesive zone for applying adhesive to a plurality of longitudinally extending warp strands and applying said adhesive carrying warp strands to said laterally extending, full width weft strands;

means in said heating zone for air blowing and drying said adhesive to join said warp and weft strands at their intersections into a unitized strippable netting; and means in said stripping zone for unclamping said calbes from their respective grooves in said belts to strip said unitized netting from said machine as a unitary, self-supporting product.

* * * * *